US006478337B1

(12) United States Patent
Toda et al.

(10) Patent No.: US 6,478,337 B1
(45) **Date of Patent: *Nov. 12, 2002**

(54) BOOK WITH INDEXING MEANS

(76) Inventors: Akinori Toda, 30-1-401, Matsugaya, Hachioju-shi, Tokyo (JP); Yoshio Ohashi, Shonan-seibu 2-9-936, Ohba 5055-10, Fujisawa-shi, Kanagawa-ken (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/314,147

(22) Filed: May 19, 1999

(51) Int. Cl.[7] ..... B42F 21/00

(52) U.S. Cl. ..... 283/38; 281/37; 283/36; 283/42

(58) Field of Search ..... 281/37, 38; 283/36, 283/38, 41, 42; 402/79

(56) References Cited

U.S. PATENT DOCUMENTS 2,369,173 A * 2/1945 Oppenheimer ..... 283/42
3,817,492 A * 6/1974 Raymer ..... 283/36
4,427,290 A * 1/1984 Kaye et al. ..... 283/36
4,715,621 A * 12/1987 Colavito et al. ..... 283/36
4,811,974 A * 3/1989 Ho ..... 283/36
4,927,178 A * 5/1990 Schechter ..... 283/36
4,949,999 A * 8/1990 Ke-hui ..... 283/36
5,127,677 A * 7/1992 Merry ..... 283/36
5,624,138 A * 4/1997 Park ..... 283/36

FOREIGN PATENT DOCUMENTS

JP 46-8803 3/1971
JP 8-29626 3/1996

* cited by examiner

*Primary Examiner*—A. L. Wellington
*Assistant Examiner*—Monica Carter
(74) *Attorney, Agent, or Firm*—Finnegan, Henderson, Farabow, Garrett & Dunner, L.L.P.

(57) ABSTRACT

A book with an indexing means is disclosed, wherein by printing plural external letters created by splitting a desired character or graphic evenly onto each of adjacent odd number pages or even number pages on the edge of the book continuously in succession, the desired character or graphic appears on the side face when the book is taken in hand to open. A book with an indexing means is also disclosed, wherein by bonding slips of paper on which plural external letters are printed to each of adjacent odd number pages or even number pages on an edge continuously in succession, a desired character or graphic appears on the side face when the book is taken in hand to open.

3 Claims, 3 Drawing Sheets

Even splitting of index letter

A character created by splitting the index letter evenly is attached to each page.

side face

An index letter or an extension of the external letter appears when the side face of a book is opened.

printed on side face after binding

BOOK WITH INDEXING MEANS

BACKGROUND OF THE INVENTION

1. Field of the Invention

This invention is of use in not only the printing/publication industry which handles ordinary books but also special items regardless of field such as song books and commodity catalogs. Further, because this invention makes it possible to display not only index items but also corporate name, symbol mark, characters or the like, this can be used in every field by using a book itself as a advertising medium.

2. Description of the Related Art

Conventionally in books whose pages must be divided according to items, such as a dictionary, song book, catalog and the like, index letters on indentations in the pages in the form of a staircase according to items, index letters printed on the margin of each page in the form of a staircase according to items, index letters printed directly on the overlapping edges of the pages of a book according to items and the like are generally used. The index letters on indentations to facilitate search, however have the disadvantage that production cost is increased and production time is extended because a manufacturing step for cutting out is required. The index letters printed on the margin of each page in the form of a staircase has the disadvantage that search thereby is troublesome because no items appear on the edge although no additional manufacturing step is added. The index letters printed directly on the side face has the disadvantage that production cost and production time cannot be reduced because a step for printing items is added after binding, although search thereby is easy. To solve such disadvantages, some books print some index letters directly on the side face, and print the other index letters in margins in the form of a staircase. However, in this case, the step for printing items on the side face after binding cannot be avoided, and therefore it is difficult to reduce production cost and production time. As described above, it is difficult for a book with the conventional indexing means to satisfy the two requirements of ease of search and reduction of production cost and production time.

SUMMARY OF THE INVENTION

Although the present invention is applicable for every kind of book, specifically it can be effectively used for a dictionary, song book, catalog and the like whose pages must be divided according to item or category.

An object of the present invention is to provide a book with indexing means having a high retrieval performance and which is easy to produce, at low cost. Print deviations or cutting errors inevitably occur upon printing or binding.

Therefore, another object of the present invention is to provide a book with means to prevent gaps in any character or graphic.

Still another object of the present invention is to provide a book with means to be used as an advertising medium, raising its interest to readers.

To achieve the above object, according to an aspect of the present invention, a book is provided with indexing means wherein by printing plural external letters, created by splitting a desired character or graphic evenly, on each of adjacent odd number pages or even number pages on the edge of a book continuously in succession, the desired character or graphic appears on the edge when the book is taken in hand to open.

Further, according to another aspect of the present invention, a book is also provided with indexing means wherein by bonding slips of paper in which the above plural external letters are printed to each of adjacent odd number pages or even number pages on an edge continuously in succession, the desired character or graphic appears on the edge when the book is taken in hand to open.

Still further, the present invention also proposes a book with indexing means mentioned above wherein each of the plural external letters includes the portions of the two bands to the left and right which are immediately adjacent to it in the original character. Thus there is a partial overlap of external letters with those of adjacent odd number pages or even number pages.

DESCRIPTION OF THE PREFERRED EMBODIMENTS

Figure 1A:
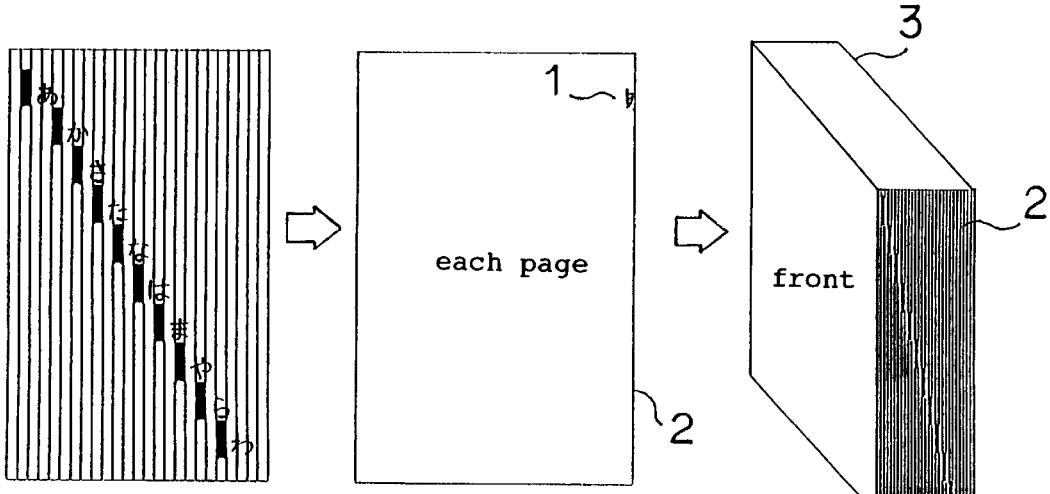
FIG. 1A is a schematic diagram indicating the production process for a book having an indexing means according to the present invention.
Figure 1B:
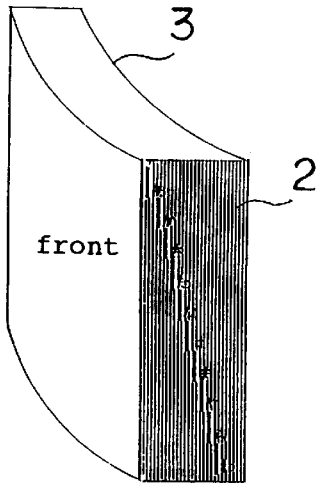
FIG. 1B is a schematic perspective view showing a state in which a book having the indexing means of the present invention is taken in hand to open.
Figure 3:
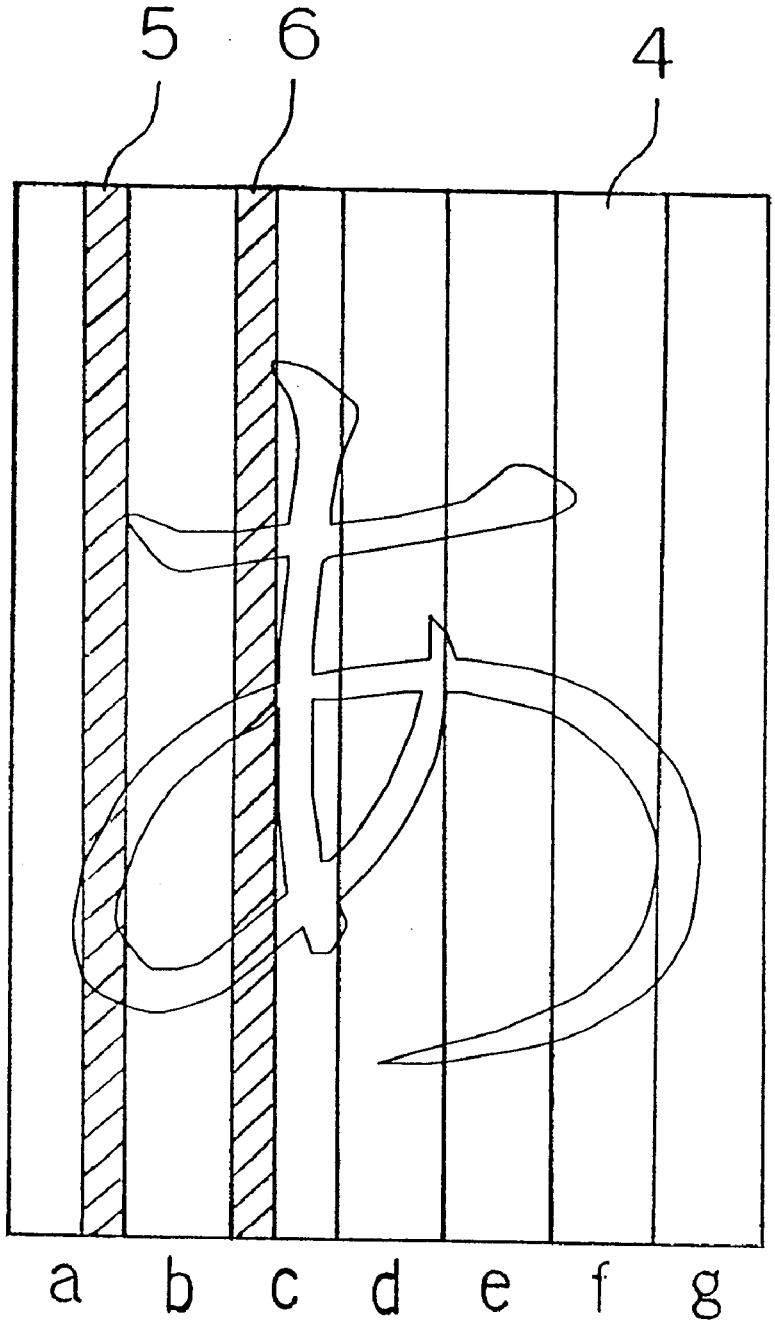
FIG. 3 is a schematic diagram showing a structure of the indexing means of the present invention, provided with print overlap.

Hereinafter, the structure of a book having an indexing means of the present invention will be described with reference to the accompanying drawings. Referring to FIG. 1, reference numeral 1 denotes an external character which is created by splitting up a desired letter or graphic into equal bands and referred to as a part of the aforementioned divided letter or graphic. Reference numeral 2 denotes an edge of a book and reference numeral 3 denotes that book. Referring to FIG. 3, a to g denote plural sections formed when a desired letter or graphic is divided. Reference numeral 4 denotes a slip of paper, which is formed by cutting sections a to g. Reference numerals 5, 6 denote an extension of the external letter to be printed together with band "6" which is a part of a structure of overlapping external characters printed on adjacent odd or even pages.

Figure 2A:
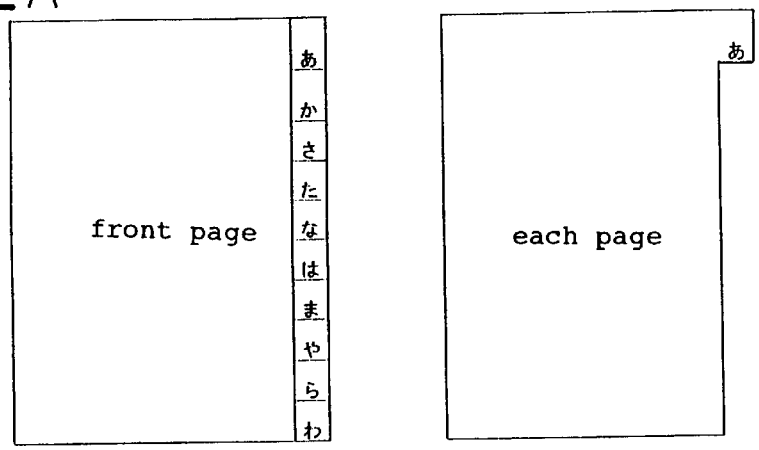
FIG. 2A PRIOR ART
FIG. 2A is a schematic diagram showing the structure of the indexing means of a conventional book.
Figure 2B:
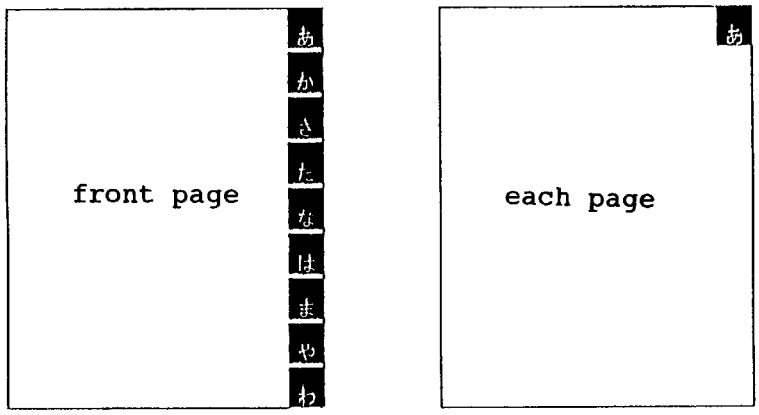
FIG. 2B PRIOR ART
FIG. 2B is a schematic diagram showing the structure of the indexing means of a conventional book.
Figure 2C:
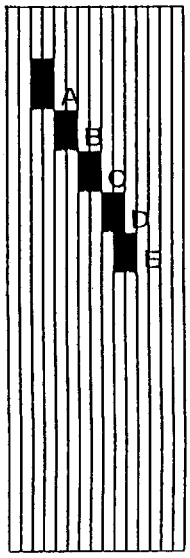
FIG. 2C PRIOR ART
FIG. 2C is a schematic diagram showing the structure of the indexing means of a conventional book.

In books having conventional indexing means, an index indented in the shape of staircase as shown in FIG. 2A, an index printed in the form of staircase as shown in FIG. 2B, an index printed directly on the overlapping edges as shown in FIG. 2C and the like are generally used. None of them satisfy the requirements for ease of search, reduction of cost and production time and the like.

Books having the indexing means of the present invention include the case in which the external letter 1 is printed as part of the printing process of book 3 and a case in which a slip of paper 4 on which the external letter 1 is printed is bonded after production of the book 3. Creation of the external letter 1 is carried out by splitting a desired letter or graphic evenly on a computer screen by means of computer control. Although in FIG. 1A, letters "A" to "WA" (Japanese letters) are split evenly into three sections, the number of divisions is increased or decreased depending on the number of pages (thickness), paper quality, etc., of book 3. In case of printing the external letter 1 on the edge 2 of the book 3 according to the present invention, printing of the external letter is completed when the printing process of the book 3 is terminated. On the other hand, in case of bonding slips of paper 4 after production of the book of is completed, the slips of paper 4 are created by splitting a desired letter or graphic in sections a to g by computer control after which they are mechanically bonded continuously to odd number pages or even number pages adjacent to each other on the edge 2. Although according to the present invention, it is expected that attaching of the indexing means is carried out entirely mechanically, it is possible both to cut the created slips of paper 4 to sections a to g and to bond them by hand.

Figure 1C:
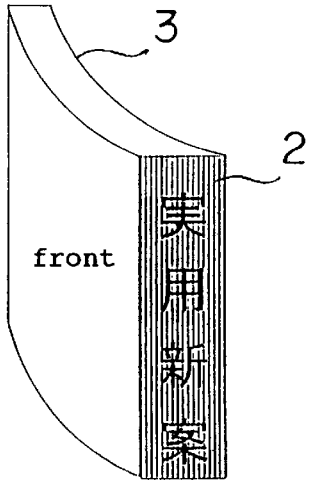
FIG. 1C is a schematic perspective view showing a state in which a book having the indexing means of the present invention is taken in hand to open.

In this manner, external characters 1 created by splitting a desired letter or graphic are printed continuously on odd number pages or even number pages adjacent to each other on the edge 2 of the book 3 in succession, a number of prepared slips of paper 4 are bonded continuously on the odd number pages or even number pages in succession so as to complete a book having the desired indexing means. Although in the completed book 3, index items are indicated in the form of a staircase as shown in FIG. 1A if it is viewed from its side, by trying to open pages, an index letter appears on the edge 2. The present invention is not restricted to the index letters, but it is possible to express letters meaning, for example, "Utility Model" as shown in FIG. 1C, corporate names, symbol marks, comic book characters or the like so that it is possible to provide the book 3 itself with a function as an advertising medium.

In books having the indexing means of the present invention, by printing extensions of each external letter which overlap the external letters printed on a surface of adjacent odd number pages or even number pages or printed on the slips of paper to be bonded to those pages as in FIG. 3, retrieval efficiency and reduction of production time can be achieved. Reference numerals 5, 6 denote an extension of the external letter. Reference numeral 5 denotes an extension of the external letter whose structure partially overlaps the external letter printed on the preceding page or slips of paper 4 to be bonded thereto. Reference numeral 6 denotes an extension of the external letter whose structure partially overlaps the external letter printed on the following page or the slips of paper 4 to be bonded thereto. In FIG. 3, plural external characters created by dividing a Japanese letter "A" equally are printed on sections a to g in succession. For example, the external letter in section b is extended to portion 5 whose structure partially overlaps the external letter in section a printed on the preceding page and extended to portion 6 whose structure partially overlaps the external letter in section c printed on the following page. Although not shown, the same extensions are attached to not only section b but to all the sections.

Upon printing or binding, an error due to deviation of print or cutting always occurs. By extending the external letter of each section with the equivalent of portions 5, 6 as shown in FIG. 3, visual continuity is never lost in expressed characters even if such an inconvenience occurs. For example in FIG. 1, if the external letter of section b is printed on an odd number page or the slips of paper 4 to be bonded thereto, even if a cutting error occurs, visual continuity is never lost because portion 6, being attached to the edge 2 which is cut upon binding, partially overlaps the external letter of section c. Because portion 5 whose structure partially overlaps the external letter of section a is attached, even if a gap between the page on which the external letter of section b is printed and the page on which the external letter of section a is printed is opened more than a required when the book 3 is taken in hand to open, the desired character or graphic is represented with continuity. Conversely, in the case where the external letter of section b is printed on an even number page or the slips of paper 4 to be bonded thereto, even if an error occurs in cutting the edge 2, continuity of the index is never lost because portion 5 whose external letter partially overlaps the external letter of section a is attached. Further, because portion 6 whose structure partially overlaps the external letter of section c is attached, even if an gap between both the pages is opened more than a required when the book is taken in hand to open, continuity of the character is not lost, and the desired character or graphic is displayed.

In a book provided with an indexing means of the present invention, more specifically in the case where printing of the external letters as the indexing means is carried out together with the printing process of the book 3, the number of production days can be largely reduced thereby reducing production cost, because printing of the external letters is completed at the same time the printing process is terminated. In the case where the slips of paper 4 are attached after binding, the attachment work can be carried out mechanically and continuously without disruptions due to print deviation or cutting error which occurs upon printing or binding because the attachment work is carried out after the binding. Therefore, difficulty of production in this case is largely reduced as compared with when conventional index letters are printed directly on the side face, carefully confirming positions of items, although this is also carried out after binding. In the conventional books, although index items appear clearly until the book is picked up by hand, when one begins to open the book, the items spread laterally so that they become difficult to read, thereby making search difficult. Further, in case of an index letter in which items are printed in the form of a staircase within a page as shown in FIG. 2B, the items cannot be recognized until the pages are opened. Therefore, it is necessary to search the item of each page with eyes by flipping through the pages with one's fingers. However, according to the present invention, by holding the book 3 and trying to open it, the index is displayed clearly on the side face so that there is no need to take the trouble of searching the items in the pages one by one.

What is claimed is:

1. A book with indexing means, said book comprising a plurality of pages and having a side face formed by free edges of the pages and plural external characters or graphics on a surface of each page adjacent the free edges thereof that form the indexing means, the characters or graphics being formed by splitting a desired character or graphic into a plurality of equal sections and providing the sections continuously in succession on said surface of a plurality of adjacent odd numbered pages or adjacent even numbered pages, said section of the desired character or graphic provided on one page having a portion thereof that is identical in shape to a portion of the section provided on the next adjacent page, whereby the characters or graphics appear when the book is in a closed position and the side face of the book is inclined.

2. The book of claim 1, wherein the sections of the desired character or graphic are printed on the pages.

3. The book of claim 1, wherein the sections of the desired character or graphic are printed on slips of paper that are then bonded to the pages.

* * * * *

UNITED STATES PATENT AND TRADEMARK OFFICE

CERTIFICATE OF CORRECTION

PATENT NO. : 6,478,337 B1
DATED : November 12, 2002
INVENTOR(S) : Akinori Toda et al.

It is certified that error appears in the above-identified patent and that said Letters Patent is hereby corrected as shown below:

Title page,
Item [76], Inventors, "Hajioju-shi" should read -- Hajiouji-shi --.

Insert item

-- [30] Foreign Application Priority Data

May 21, 1998 (JP) ……..10-003912 --.

Signed and Sealed this

Sixteenth Day of September, 2003

JAMES E. ROGAN
*Director of the United States Patent and Trademark Office*